US008314783B2

(12) United States Patent
Sambandan et al.

(10) Patent No.: US 8,314,783 B2
(45) Date of Patent: Nov. 20, 2012

(54) METHOD AND SYSTEM FOR CALIBRATING A LIGHT EMITTING DEVICE DISPLAY

(75) Inventors: Sanjiv Sambandan, Waterloo (CA); Peyman Servati, Waterloo (CA); Arokia Nathan, Waterloo (CA)

(73) Assignee: Ignis Innovation Inc., Waterloo, Ontario (CA)

( * ) Notice: Subject to any disclaimer, the term of this patent is extended or adjusted under 35 U.S.C. 154(b) by 1466 days.

(21) Appl. No.: 11/291,301

(22) Filed: Dec. 1, 2005

(65) Prior Publication Data

US 2006/0149493 A1 Jul. 6, 2006

(30) Foreign Application Priority Data

Dec. 1, 2004 (CA) ..... 2490861

(51) Int. Cl.
*G09G 5/00* (2006.01)

(52) U.S. Cl. ..... 345/204; 345/76; 345/55

(58) Field of Classification Search ..... 345/204, 345/76, 55

See application file for complete search history.

(56) References Cited

U.S. PATENT DOCUMENTS

| | | | | |
|---|---|---|---|---|
| 7,304,621 | B2 * | 12/2007 | Oomori et al. | 345/82 |
| 2002/0030647 | A1 | 3/2002 | Hack et al. | |
| 2003/0169219 | A1 * | 9/2003 | LeChevalier | 345/84 |
| 2004/0056604 | A1 * | 3/2004 | Shih et al. | 315/169.2 |
| 2004/0129933 | A1 | 7/2004 | Nathan et al. | |
| 2004/0201554 | A1 * | 10/2004 | Satoh | 345/76 |
| 2007/0080918 | A1 * | 4/2007 | Kawachi et al. | 345/92 |

FOREIGN PATENT DOCUMENTS

| | | | |
|---|---|---|---|
| JP | 10-153759 | * | 6/1998 |
| JP | 2000-089198 A | * | 3/2000 |
| JP | 2003-150082 A | * | 5/2003 |

OTHER PUBLICATIONS

Goh Joon-Chul, et al., "A New a-Si:H Thin-Film Transistor Pixel Circuit for Active-Matrix Organic Light-Emitting Diodes", IEEE Electron Device Letters, vol. 24, No. 9, Sep. 2003, pp. 583-585.

Nathan Arokia, et al., "Amorphous Silicon Thin Film Transistor Circuit Integration for Organic LED Displays on Glass and Plastic", IEEE Journal of Solid-State Circuits, vol. 39, No. 9, Sep. 2004, pp. 1477-1486.

Sanford James L., et al., "4.2: TFT AMOLED Pixel Circuits and Driving Methods", SID 03 Digest, ISSN/0003, 2003, pp. 10-13.

Alexander et al.: "Pixel circuits and drive schemes for glass and elastic AMOLED displays"; dated Jul. 2005 (9 pages).

Chaji et al.: "A low-power driving scheme for a-Si:H active-matrix organic light-emitting diode displays"; dated Jun. 2005 (4 pages).

Chaji et al.: "A low-power high-performance digital circuit for deep submicron technologies"; dated Jun. 2005 (4 pages).

(Continued)

*Primary Examiner* — William Boddie
*Assistant Examiner* — Leonid Shapiro
(74) *Attorney, Agent, or Firm* — Nixon Peabody LLP

(57) ABSTRACT

A method and system for calibrating a light emitting device display is provided. The display includes a plurality of pixel circuits, each having a light emitting device. The system for the calibration monitors current drawn from a row of the display array, and generates a correction parameter to correct brightness level of the light emitting device.

42 Claims, 6 Drawing Sheets

OTHER PUBLICATIONS

Chaji et al.: "A novel a-Si:H AMOLED pixel circuit based on short-term stress stability of a-Si:H TFTs"; dated Oct. 2005 (3 pages).
Chaji et al.: "A novel driving scheme for high-resolution large-area a-Si:H AMOLED displays"; dated Aug. 2005 (4 pages).
Chaji et al.: "Driving scheme for stable operation of 2-TFT a-Si AMOLED pixel"; dated Apr. 2005 (2 pages).
Chaji et al.: "Dynamic-effect compensating technique for stable a-Si:H AMOLED displays"; dated Aug. 2005 (4 pages).
Chaji et al.: "eUTDSP: a design study of a new VLIW-based DSP architecture"; dated May 2003 (4 pages).
Chaji et al.: "High Speed Low Power Adder Design With a New Logic Style: Pseudo Dynamic Logic (SDL)"; dated Oct. 2001 (4 pages).
Chaji et al.: "Pseudo dynamic logic (SDL): a high-speed and low-power dynamic logic family"; dated 2002 (4 pages).
Jafarabadiashtiani et al.: "A New Driving Method for a-Si AMOLED Displays Based on Voltage Feedback"; dated 2005 (4 pages).
Matsueda y et al.: "35.1: 2.5-in. AMOLED with Integrated 6-bit Gamma Compensated Digital Data Driver"; dated May 2004.
Nathan et al.: "Driving schemes for a-Si and LTPS AMOLED displays"; dated Dec. 2005 (11 pages).
Philipp: "Charge transfer sensing" Sensor Review, vol. 19, No. 2, Dec. 31, 1999, 10 pages.
Rafati et al.: "Comparison of a 17 b multiplier in Dual-rail domino and in Dual-rail D L (D L) logic styles"; dated 2002 (4 pages).
Safavian et al.: "Self-compensated a-Si:H detector with current-mode readout circuit for digital X-ray fluoroscopy"; dated Aug. 2005 (4 pages).
Safavian et al.: "TFT active image sensor with current-mode readout circuit for digital x-ray fluoroscopy [5969D-82]"; dated Sep. 2005 (9 pages).
Yi He et al., "Current-Source a-Si:H Thin Film Transistor Circuit for Active-Matrix Organic Light-Emitting Displays", IEEE Electron Device Letters, vol. 21, No. 12, Dec. 2000, pp. 590-592.

* cited by examiner

METHOD AND SYSTEM FOR CALIBRATING A LIGHT EMITTING DEVICE DISPLAY

FIELD OF INVENTION

The present invention relates to a light emitting device display, and more specifically to a method and system for calibrating the light emitting device display.

BACKGROUND OF THE INVENTION

Recently active-matrix organic light-emitting diode (AMOLED) displays with amorphous silicon (a-Si), poly-silicon, organic, or other driving backplane have become more attractive due to advantages over active matrix liquid crystal displays (AMLCDs). For example, the advantages include: lower power, wider viewing angle, and faster refresh rate displays.

Currently most of the AMOLED displays use poly-silicon backplanes. However, due to its relative infancy, ongoing processing concerns, and limited available capacity, the usage of the poly-silicon backplanes does not lend itself to low-cost manufacturing.

By contrast, amorphous silicon (a-Si) leverages the vast installed infrastructure of proven AMLCD production, promising much lower manufacturing costs as opposed to that of polysilicon. As well, an a-Si solution exposes the large global base of current liquid crystal display manufacturers to the AMOLEDs, thereby accelerating its introduction commercially.

However the usage of a-Si in AMOLED backplanes encounters two issues, namely low mobility and device instability due to the shift of the threshold voltage of a transistor. The threshold voltage shift poses a design constrain for the AMOLED backplanes.

To overcome these issues, many pixel circuits have been proposed ([Ref. 1] A. Nathan, A. Kumar, K. Sakariya, P. Servati, S. Sambandan, K. S. Karim, D. Striakhilev, "Amorphous silicon thin film transistor circuit integration for organic LED displays on glass and plastic," IEEE Journal of Solid State Circuits, vol. 39, pp. 1477-1486, 2004, [Ref. 2] J.-C. Goh, J. Jang, K.-S. Cho, and C.-K. Kim, "A new a-Si:H thin-film transistor pixel circuit for active-matrix organic light-emitting diodes," IEEE Electron Device Lett., vol. 24, no. 9, pp. 583-585, 2003, [Ref. 3] James L. Sanford and Frank R. Libsch, "TFT AMOLED Pixel Circuits and Driving Methods," SID 2003, pp. 10-13). These circuits can be broadly classified as being either current programmed or voltage programmed.

Despite the accuracy, the current programmed circuits by A. Nathan et al. [Ref. 1] may face a "settling time" problem due to the low transconductance of the a-Si TFT coupled with a high line capacitance.

The voltage programmed circuits by J.-C. Goh, et al. [Ref. 2] and James L. Sanford et al. [Ref. 3] generally do not suffer from this "settling time" problem. However, they require techniques to decrease the dependence of OLED current on the threshold shift of a thin film transistor (TFT).

Numerous other compensation techniques have been introduced. However they either use complex pixel circuits, each having more than 2 TFTs and/or have programming methods which suffer from the same programming time issues as with current programmed circuits.

SUMMARY OF INVENTION

It is an object of the invention to provide a method and system that obviates or mitigates at least one of the disadvantages of existing systems.

In accordance with an aspect of the present invention, there is provided a system for calibration of a display array having a plurality of pixel circuits, which includes: an error extraction system for extracting error including: a first module for monitoring a row current in a row of the display array; a second module for generating a reference current; and a third module for obtaining an error between the row current and the reference current, and an error estimation system for estimating a correction parameter based on the error to adjust a data voltage applied to the display array.

In accordance with a further aspect of the present invention, there is provided a of calibration of a display array having a plurality of pixel circuits, includes the steps of: extracting error, including: providing a reference current; monitoring a row current in a row of the display array; and for the row, obtaining an error between the row current and the reference current, estimating a correction parameter for the row based on the error and a total data voltages applied to the pixel circuits in the row of the display array.

This summary of the invention does not necessarily describe all features of the invention.

Other aspects and features of the present invention will be readily apparent to those skilled in the art from a review of the following detailed description of preferred embodiments in conjunction with the accompanying drawings.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENTS OF THE INVENTION

Embodiments of the present invention is described using a pixel circuit having an organic light emitting diode (OLED) and a drive thin film transistor (TFT). However, the pixel circuit described herein may include a light emitting device other than the OLED, and may include a transistor(s) other than the TFT. It is noted that in the description, "pixel circuit" and "pixel" may be used interchangeably.

Figure 1:
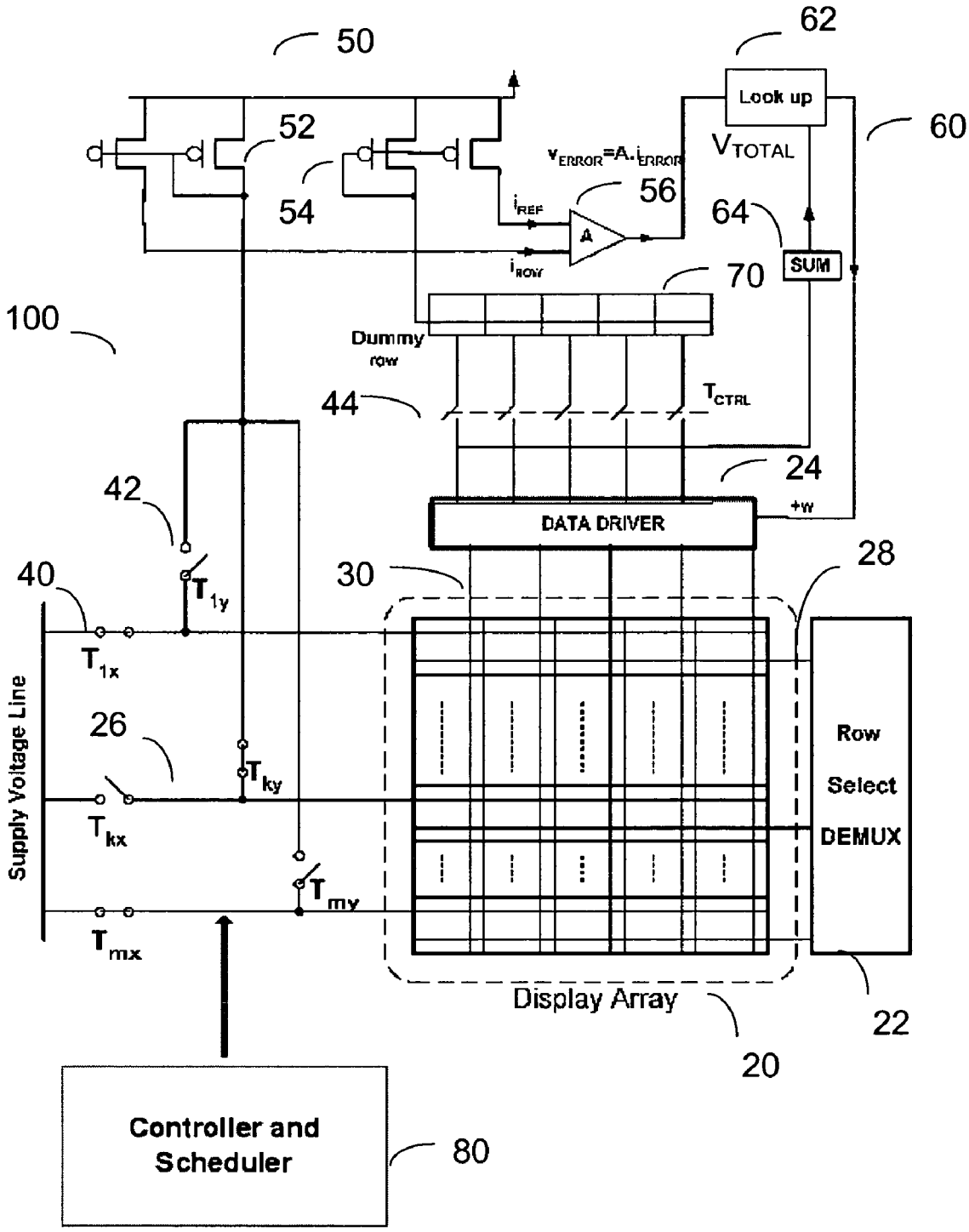
FIG. 1 is a diagram showing system architecture for implementing a calibration technique in accordance with an embodiment of the present invention to a display array.

FIG. 1 is a diagram showing system architecture for implementing a calibration technique in accordance with an embodiment of the present invention to a display array 20. Referring to FIG. 1, an external calibration system 100 is provided outside the display array 20. The calibration system 100 includes a switch network system for selectively implementing one of a normal display operation and a calibration operation to the display array 20, an error extraction system 50 for extracting error information related to the shift of the characteristic(s) of a pixel using a dummy row 70, a correction parameter estimation system 60 for providing a correction parameter w for compensation, and a controller and scheduler 80 for managing the normal display operation (mode) and the calibration (mode).

The display array 20 includes a plurality of voltage-programmed pixel circuits arranged in row and column. The pixel circuit may be a top or bottom pixel circuit. Each row of the display array 20 is connected to a voltage supply line 26 (e.g. $V_{DD}$ of FIG. 2), hereinafter referred to as $V_{DD}$ line 26. Each row of the display array 20 is selected by a select line 28 (i.e. SEL of FIG. 2) connected to a row select demultiplex (DEMUX) 22. Each column of the display array 20 is driven by a signal line 30 (e.g. $V_{DATA}$ of FIG. 2) connected to a data driver 24.

The pixel circuit in the display array 20 with the calibration system 100 may be fabricated using conventional logic circuitry technology, such as CMOS, NMOS, HVCMOS and BiMOS integrated circuit technology.

The dummy row 70 is described in detail. The dummy row 70 is a row of pixel circuits. Each pixel circuit in the dummy row 70 has a structure same as that of the pixel circuit in the display array 20. The dummy row 70 has the same number of columns as that of the display array 20. In FIG. 1, 5 column lines are shown as example. The pixel circuit in the dummy row 70 is referred to as a dummy row pixel.

During the calibration, each dummy row pixel receives a data voltage from the data driver 24. During the normal display operation, the dummy row 70 is disconnected from the data driver 24, thus, does not have to display images.

The drive transistors of the dummy row pixels (e.g. transistor 8 of FIG. 2) are stressed occasionally, only for the calibration, and thus are not expected to have a threshold voltage shift. These drive transistors of the dummy row pixels provide a reference current $i_{REF}$ to the initial threshold voltage. During the calibration, the monitored row current is compared to this reference current $i_{REF}$.

The switch network system of the calibration system 100 is described in detail. The switch network system includes switch networks 40, 42 and 44. The switch network 40 is provided for the rows of the display array 20 for the normal display operation. The switch network 42 is provided for the rows of the display array 20 for the calibration. The switch network 44 is provided for the columns of the dummy row 70 for the calibration. The controller and scheduler 80 controls the switch networks 40, 42 and 44 to implement the normal display operation and the calibration.

The switch network 40 includes a switch $T_{kx}$ for the kth row of the display array 20 (k=1, . . . , m: m is the number of the rows). The $V_{DD}$ line 26 for the kth row of the display array 20 is selectively connected to a main voltage supply line $V_{DDX}$ through the switch $T_{kx}$.

The switch network 42 includes a switch $T_{ky}$ for the kth row of the display array 20 (k=1, . . . , m: m is the number of the rows). The $V_{DD}$ line 26 for the kth row of the display array 20 is selectively connected to the error extraction system 50 through the switch $T_{ky}$.

The switch network 44 includes a plurality of switches $T_{CTRL}$. The data driver 24 is selectively connected to the dummy row 70 through the switch network 44. Each dummy row pixel receives a data voltage from the data driver 24 through the corresponding switch $T_{CTRL}$.

The switches $T_{kx}$, $T_{ky}$ and $T_{CTRL}$ may be low leakage CMOS switches, based on CMOS, NMOS, HVCMOS and BiMOS integrated circuit technology.

During the normal display operation, the controller and scheduler 80 allows the rows of the display array 20 to be connected to the main voltage supply line $V_{DDX}$. During the calibration, the $V_{DD}$ lines 26 are separately routed under the control of the controller and scheduler 80 so that the error extraction system 50 has access to the rows of the display array 20 sequentially.

The error extraction system 50 is described in detail. The error extraction system 50 monitors a total pixel current in a row of the display array 20, and compares the monitored total pixel current with an expected row current. The total pixel current is the summation of pixel currents read from the kth row of the display array 20. The error extraction system 50 generates a reference current $i_{REF}$ using the dummy row 70 as the expected row current. The error extraction system 50 compares the reference current $i_{REF}$ with the total pixel current in the row of the display array 20, and obtains error information for the row. In FIG. 1, $i_{Row}$ represents a current associated with the total pixel current in a row of the display array 20.

The error extraction system 50 includes sensors 52 and 54, and a comparator 56. The sensor 52 is selectively connected to the $V_{DD}$ line 26 for a row of the display array 20 through the switch network 42. The sensor 52 senses a current on the selected $V_{DD}$ line 26, and generates the current $i_{ROW}$. The sensor 54 senses a current drawn from the dummy row 70, and generates the reference current $i_{REF}$.

The sensors 52 and 54 are accurate CMOS current mirrors. One branch of the current mirror senses the current drawn by the dummy row 70 as is done by the sensor 54 (or row in the display array 20 as done by the sensor 52), while the other branch replicates or mirrors this current. Using these current mirrors (52 and 54), the TFT sections in the display array 20 and the dummy row 70 are isolated from the comparator 56

The comparator 56 compares the reference current $i_{REF}$ with the current $i_{Row}$, and outputs an error voltage $V_{ERROR}$. $V_{ERROR}$ is proportional to the error current $i_{ERROR}$, and is:

$$V_{ERROR}=A\cdot i_{ERROR}$$

where A represents the transfer function (e.g. gain) of the comparator 56. The transfer function A of the comparator 56 is the gain of the comparator 56 when it deals with dc currents.

The correction parameter estimation system 60 is now described in detail. The correction parameter estimation system 60 provides the correction parameter w. The correction parameter w may be obtained through a look up table 62 and a sum block 64 as shown in FIG. 1.

The sum block 64 sums the data voltages applied to the dummy row 70, and outputs it as a total data voltage $V_{TOTAL}$. The sum block 64 may include one or more Operational Amplifiers (Opamps) to perform the summation of the data voltages provided by the data driver 24.

The correction parameter w is retrieved from the look up table 62 using (a) the error current $i_{ERROR}$ provided by the comparator 56 and (b) the total data voltage $V_{TOTAL}$ provided by the sum block 64. The correction parameter w read from the look up table 62 may be stored in a capacitor (not shown) to be used during the normal display operation. The average of the correction parameters w for all of the rows may be used for the compensation.

Figure 2:
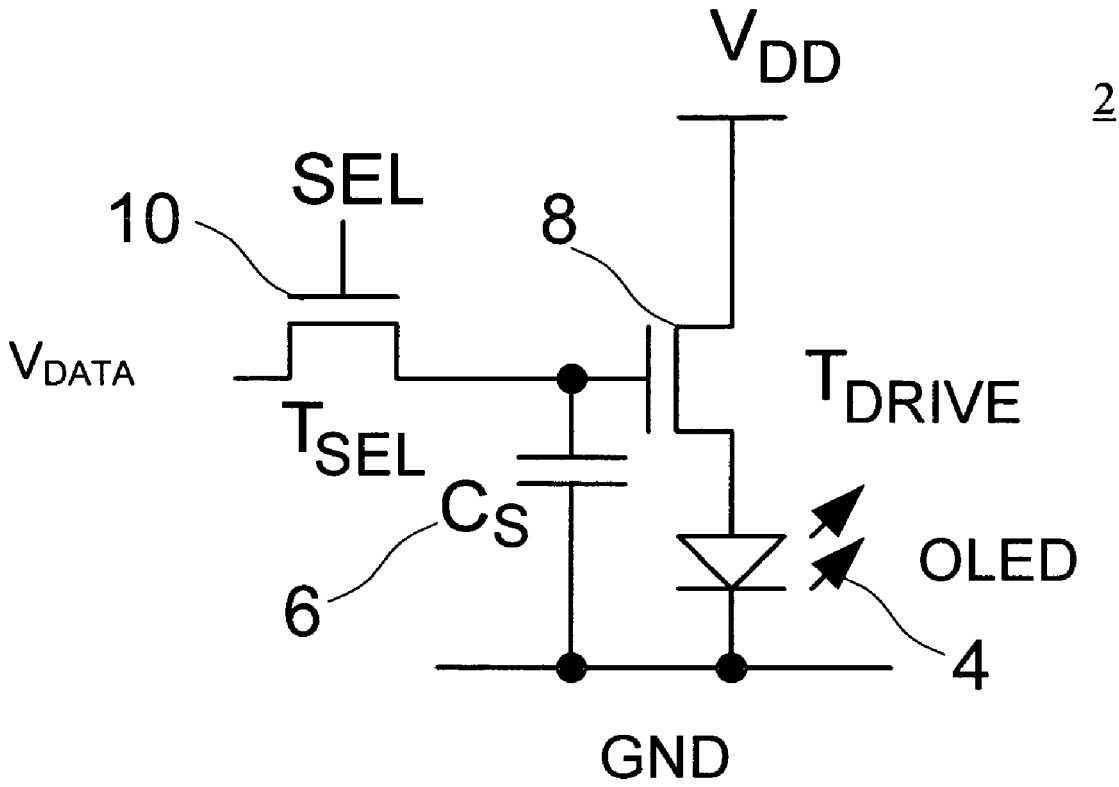
FIG. 2 Prior Art
FIG. 2 is a diagram showing an example of a conventional voltage programmed pixel circuit which is applicable to the display array of FIG. 1.

The correction parameter w is described in detail with reference to FIGS. 1 and 2. FIG. 2 illustrates a voltage programmed pixel circuit 2 which is applicable to the display array 20 of FIG. 1. It is noted that the voltage programmed pixel circuit in the display array 20 of FIG. 1 is not limited to the pixel circuit 2.

The pixel circuit 2 of FIG. 2 includes an OLED 4, a storage capacitor 6, a drive transistor 8 which operates in saturation, and a switch transistor 10. The transistors 8 and 10 are n-type TFTs. However, the transistors may be p-type transistors.

The source terminal of the drive transistor 8 is connected to the anode electrode of the OLED 4. The drain terminal of the drive transistor 8 is connected to a voltage supply line $V_{DD}$(26 of FIG. 1). The gate terminal of the drive transistor 8 is connected to the storage capacitor 6.

The gate terminal of the switch transistor 10 is connected to a select line SEL (28 of FIG. 1). In the description, "select line SEL" and "pixel select signal SEL" may be used interchangeably. The drain terminal of the switch transistor 10 is connected to a signal line $V_{DATA}$ (30 of FIG. 1). The source terminal of the switch transistor 10 is connected to the gate terminal of the drive transistor 8 and the storage capacitor 6. The storage capacitor 6 and the cathode electrode of the OLED 4 are connected to a common ground GND. The brightness of the OLED 4 is determined by the magnitude of current flowing through the OLED 4.

The normal display operation of the pixel circuit 2 includes a programming cycle and a driving cycle. During the programming cycle, the pixel select signal SEL goes high, and thus the switch transistor 10 turns on. This enables a data voltage (programming voltage) on $V_{DATA}$ to be written onto the storage capacitor 6. During the driving cycle, the switch transistor 10 turns off, and the drive transistor 8 sources programmed current into the OLED 4. The pixel circuit 2 does not internally compensate for the threshold voltage shift in the drive transistor 8.

In the calibration mode, the calibration system 100 of FIG. 1 monitors a current in a row of the display array 20, and compensates for the data voltages applied to the display array 20 so as to reduce the effects of the threshold voltage shifts. The calibration system 100 uses fuzzy technique described below. The threshold shift in the TFT is a slow process. Thus, the use of the fuzzy technique for approximate threshold shift compensation is justified.

The transfer function of the drive transistor 8 is an unknown factor. In other words, since the threshold in the drive transistor 8 may shift, the transfer function of the drive transistor 8 is time dependent.

A pixel current flowing through the OLED 4 is given by:

$$i_{PIXEL}^{kj}\beta(V_{DATA}^{kj}-\epsilon^{kj}-\nu)^2 \tag{1}$$

$$\beta=(\mu Cox W)/(2L)$$

where $i_{PIXEL}^{kj}$ represents the pixel current of the pixel circuit 2 in the kth row and jth column of the display array 20, $V_{DATA}^{kj}$ represents a data voltage applied to the pixel circuit 2 in the kth row and jth column of the display array 20 through $V_{DATA}$, ν represents the initial threshold voltage in the drive transistor 8, and $\epsilon^{kj}$ represents the threshold voltage shift in the drive transistor 8 of the pixel circuit 2 in the kth row and jth column of the display array 20, μ is the mobility, Cox is the gate capacitance per unit area, W is the channel width, and L the channel length of the drive transistor 8.

In order to compensate for the change in current flowing through the OLED 4 and thus correct brightness level, a correction parameter w is estimated and is applied to the data voltage provided to $V_{DATA}$.

Since the change in the transfer function of the drive transistor 8 is slow phenomena, the display array 20 can be calibrated occasionally and row-wise. During the calibration of the kth row, the total current in the kth row is compared to a reference current to evaluate an error:

$$i_{ERROR}^{k}=i_{REF}^{k}-i_{PIXEL}^{k} \tag{2}$$

$$i_{REF}^{k} = \sum_{j=1}^{n} \beta\left(V_{DATA}^{kj} - \upsilon\right)^2 \tag{3}$$

where $i_{ERROR}^{k}$ represents the evaluated error for the kth row, $i_{REF}^{k}$ represents the reference current for the kth row, and $i_{PIXEL}^{k}$ represents the summation of the pixel currents in the kth row (i.e. total pixel current in the kth row).

It is noted that $i_{Row}$ of FIG. 1 corresponds to $i_{PIXEL}^{k}$ of (2), $i_{REF}$ of FIG. 1 corresponds to $i_{REF}^{k}$ of (2) and (3), and $i_{ERROR}^{k}$ of FIG. 1 corresponds to $i_{ERROR}^{k}$ of (2).

The error current $i_{ERROR}^{k}$ is indicative of the amount of threshold voltage shift, and therefore is related to the correction parameter w. The correction voltage w depends on the error $i_{ERROR}^{k}$.

In this embodiment, the correction parameter w is a voltage, and is added to a data voltage so as to compensate for the difference in current, resulting in that the pixel current becomes:

$$i_{PIXEL}^{kj} = \beta\left(V_{DATA}^{kj} - \varepsilon^{kj} - \upsilon + w\right)^2 \tag{4}$$

If the threshold voltage shifts in all pixels are almost the same, the threshold voltage shift can be expressed as $\epsilon=\epsilon^{kj}$ for all k and j. When $\epsilon=\epsilon^{kj}$, the error current in the kth row can be:

$$i_{ERROR}^{k} \cong 2\beta\varepsilon\sum_{j=1}^{n}\left(V_{DATA}^{kj} - \upsilon\right) \tag{5}$$

A mapping parameter Kp, which is specific to the total data voltage and the transfer function A of the comparator 56, is defined as:

$$Kp = 2\beta A\sum_{j=1}^{n}\left(V_{DATA}^{kj} - \upsilon\right) \tag{6}$$

where β, A and ν are constants.

Thus, from (6), the mapping parameter Kp is expressed as:

$$Kp = 2\beta A\left[\sum_{j=1}^{n} V_{DATA}^{kj}\right] - 2\beta A n\upsilon \tag{7}$$

In other words, the mapping parameter Kp can be generated by summing the data voltages applied to the pixel circuits. This summing function is performed by the sum block 64 using the data voltages applied to the dummy row 70.

The correction parameter w is used to cancel the effect of the threshold voltage shift ϵ. Thus, w=ϵ. The value of ϵ can be computed from (5) and (6). It is noted that from (5) and (6), the error current in the kth row can be expressed as:

$$i_{ERROR}^{k} \cong Kp\cdot\epsilon \tag{8}$$

Thus once the mapping parameter Kp is obtained, w is obtained from (8) as follows:

$$\frac{i^k_{ERROR}}{Kp} \cong \varepsilon = w \tag{9}$$

The look up table 62 stores the ratio $$\frac{i^k_{ERROR}}{Kp},$$

along with the values of $i_{ERROR}{}^k$ and Kp. The correction parameter w, which is the ratio $$\frac{i^k_{ERROR}}{Kp},$$

is then looked up, using the nearest values of $i_{ERROR}{}^k$ and Kp obtained while actually performing the calibration.

In FIG. 1, the look up table 62 is used to obtain the correction parameter 56. However, an arithmetic processing unit may be used to directly compute the correction parameter w by actually computing $$\frac{i^k_{ERROR}}{Kp}.$$

As described below, the average of the correction parameters for all rows may be appended to the data voltages for all of the pixel circuits in the display array 20.

Figure 3:
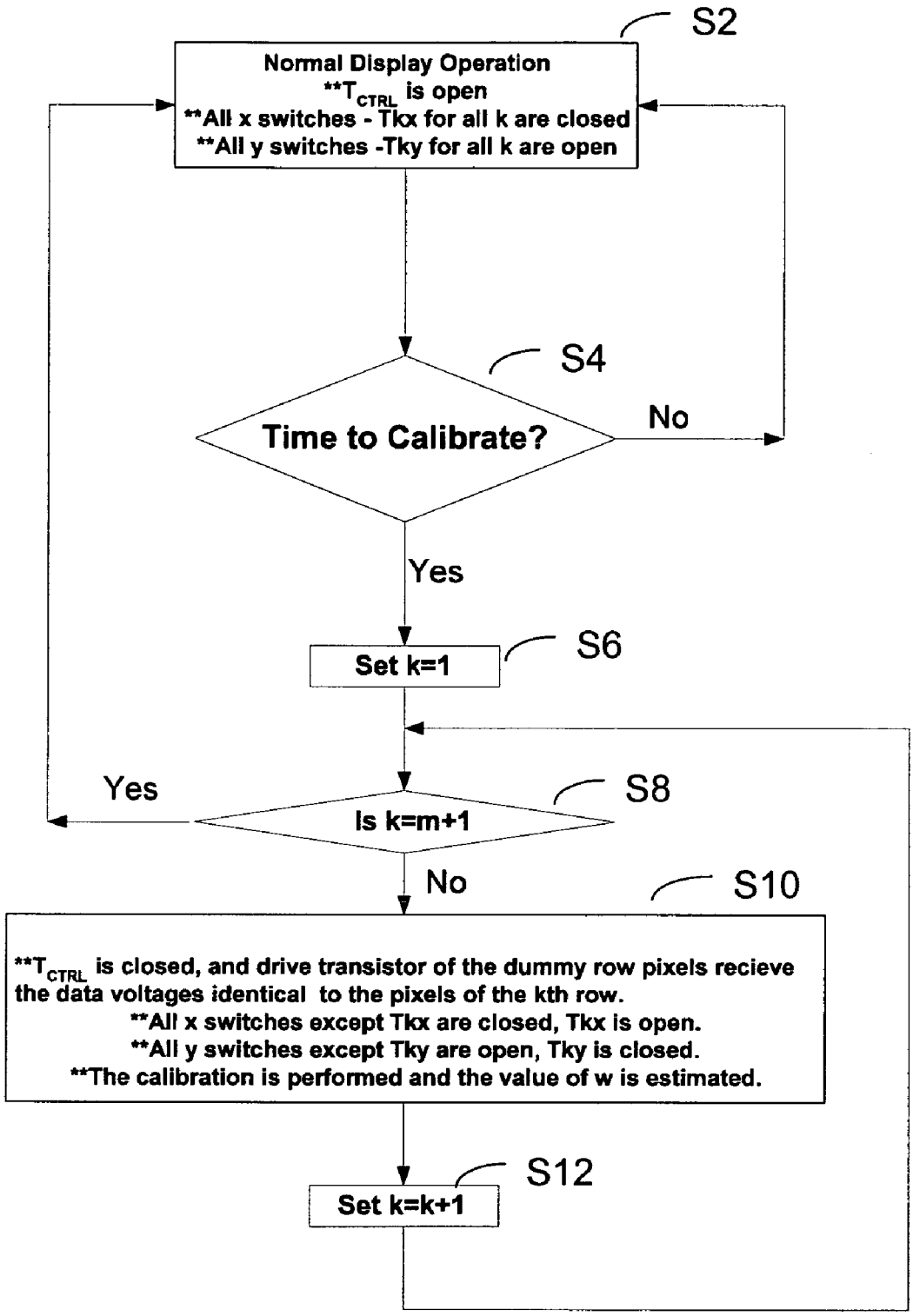
FIG. 3 is a flow chart showing an example of the operation applied to the system architecture of FIG. 1.

The operation of the display architecture of FIG. 1 is described in detail with reference to FIGS. 1 and 3. FIG. 3 illustrates an example of the operation applied to the system architecture of FIG. 1.

During the normal display operation mode, the switches $T_{1x}, \ldots, T_{mx}$ are closed, all of the switches $T_{1y} \ldots, T_{my}$ are open, and all of the switches $T_{CTRL}$ are open (step S2). The display array 20 is connected to the supply voltage line $V_{DDX}$. A current is drawn from the display array 20 through the regular VDD line 26. The normal display operation is implemented until the calibration mode is activated by the controller 70 (step S4).

When the calibration mode is activated, a counter k is initialized. The counter k is set to 1 (step S6). As described below, the counter k is incremented (step S12) until k reaches m+1 where m is the number of rows in the display array 20. The controller and scheduler 80 determines whether the value of the counter k reaches m+1 (k=m+1) (step S8). If yes (k=m+1), the operation of the display array 20 returns to the normal display operation mode (step S2). If no (k<m+1), the row associated with the value of the counter k (i.e. kth row of the display array 20) is calibrated.

During the calibration for the kth row of the display array 20 (step S10), the switch $T_{kx}$ is open, the switch $T_{ky}$ is closed, and all of the switches $T_{CTRL}$ are closed. The pixel circuits in the kth row of the display array 20 are selected by the select lines 28, and receive data voltages from the data driver 24. Since the switch $T_{ky}$ is closed, a current on the VDD line 26 of the kth row is sensed by the sensor 52. The sensor 52 generates the current $i_{Row}$, which is associated with a total pixel current for the kth row of the display array 20.

Since the switches $T_{CTRL}$ are closed, the dummy row 70 is connected to the data driver 24. The drive transistors in the dummy row pixels receive data voltages identical to those of the pixel circuits in the kth row of the display array 20. The sensor 54 senses a current drawn from the dummy row 70, and generates the reference current $i_{REF}$.

The reference current $i_{REF}$ is compared with the current $i_{Row}$ at the comparator 56. The correction parameter w for the kth row is estimated. The correction voltage w is stored for the next normal display operation.

Then the counter k is incremented (step S12). The operation goes to step S8 to determine whether the counter k reaches (m+1).

If the counter k reaches (m+1), the operation returns to step S2. The correction parameter w obtained for each row is used for that row for the compensation purpose.

Figure 5:
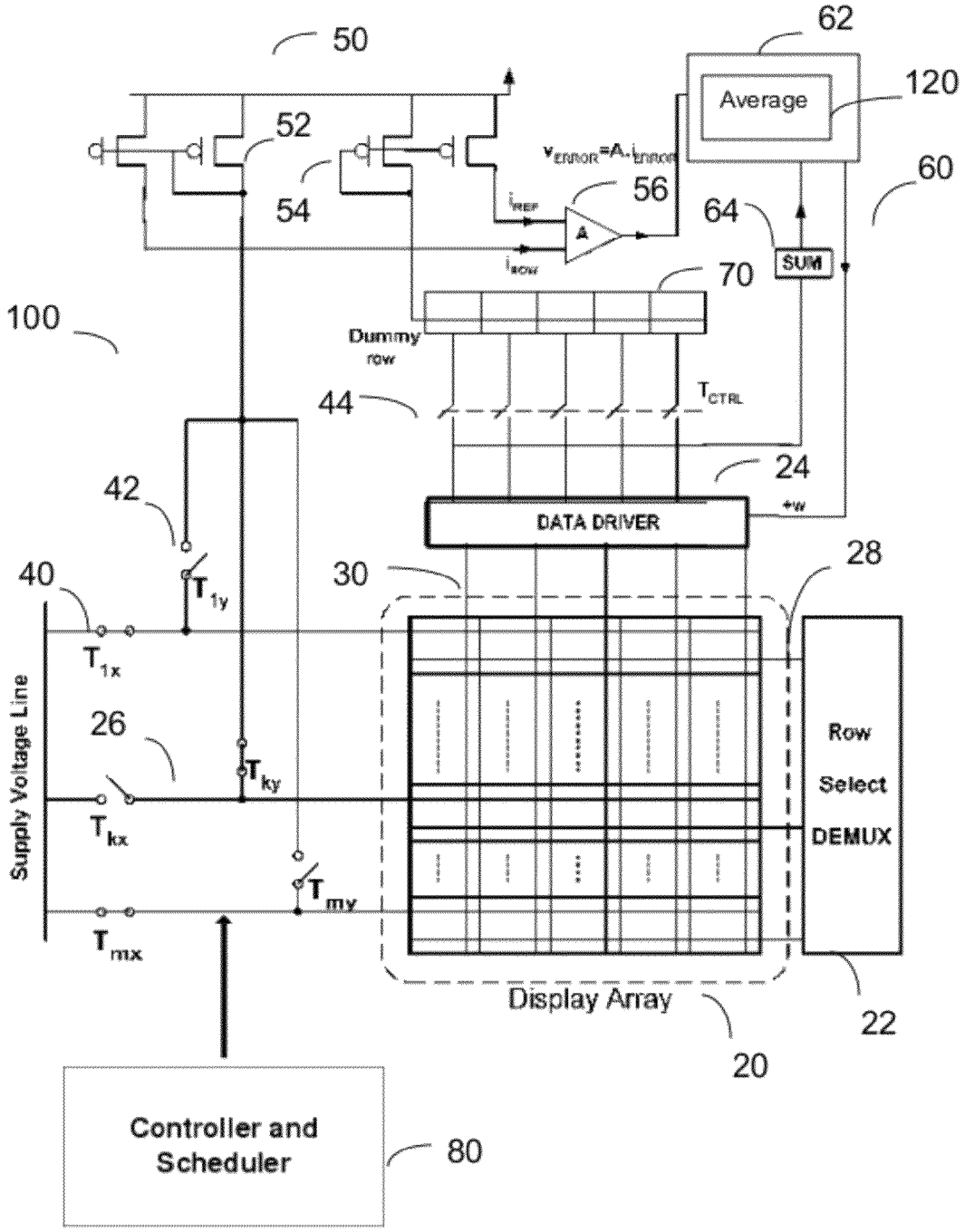
FIG. 5 is an example of the system of FIG. 1.
Figure 6:
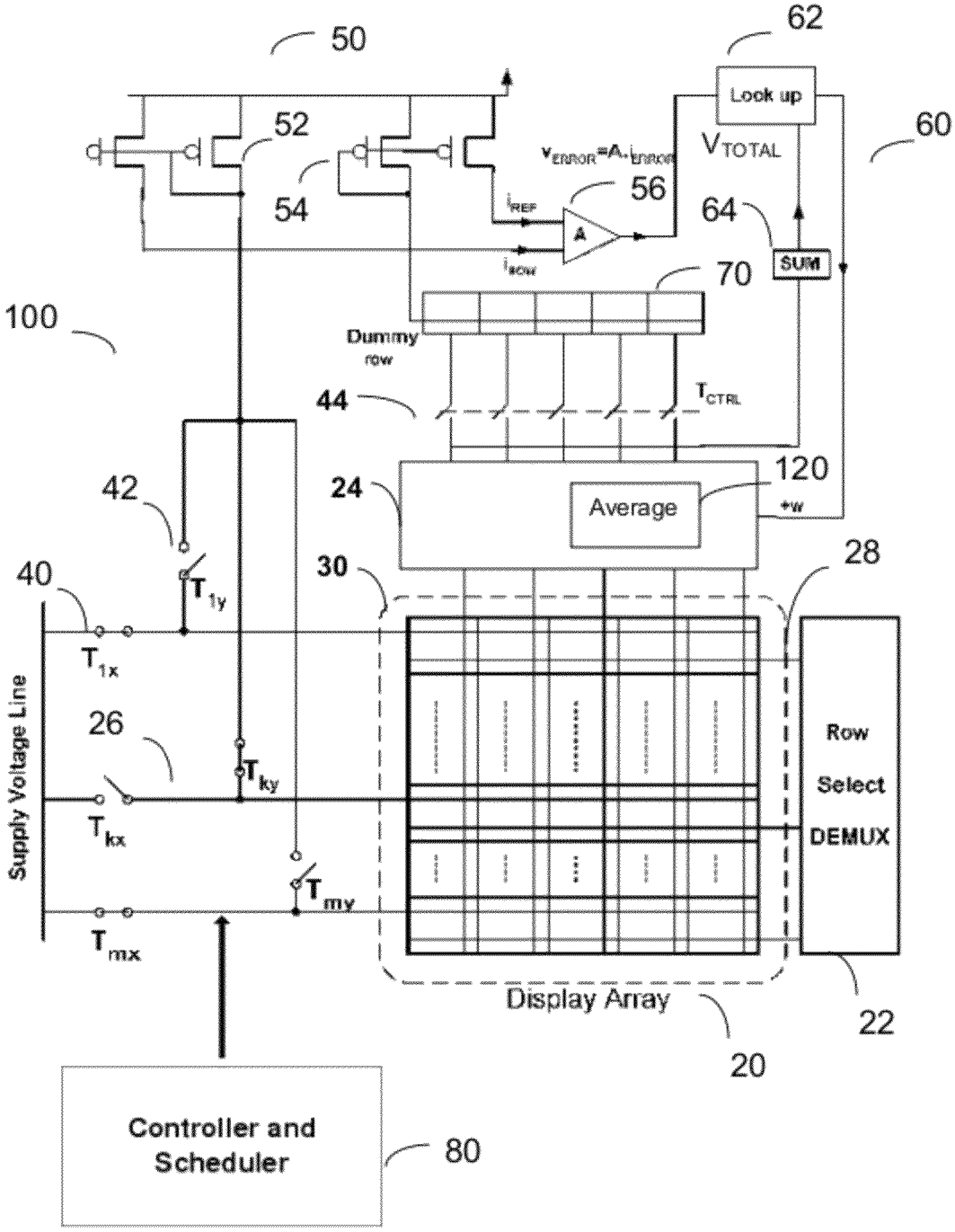
FIG. 6 is another example of the system of FIG. 1.

The average of the correction parameters obtained for all of the rows may be used for the pixel circuits in all of the rows of the display array 20 for the compensation. The average of the correction parameters may be appended to the data voltages for all pixel circuits in the display array 20 when implementing the next normal display operation. The look up table 62 or the data driver 24 may include a module 120 for calculating this average (See FIGS. 5-6).

In FIG. 3, VDD lines (26 of FIG. 1) for all rows are monitored. However, the controller and scheduler 80 of FIG. 1 may randomly select one or more rows (less than all rows), implement the step S10 of FIG. 3, and obtain one correction parameter w for all of the pixel circuits in the display array 20.

Figure 4:
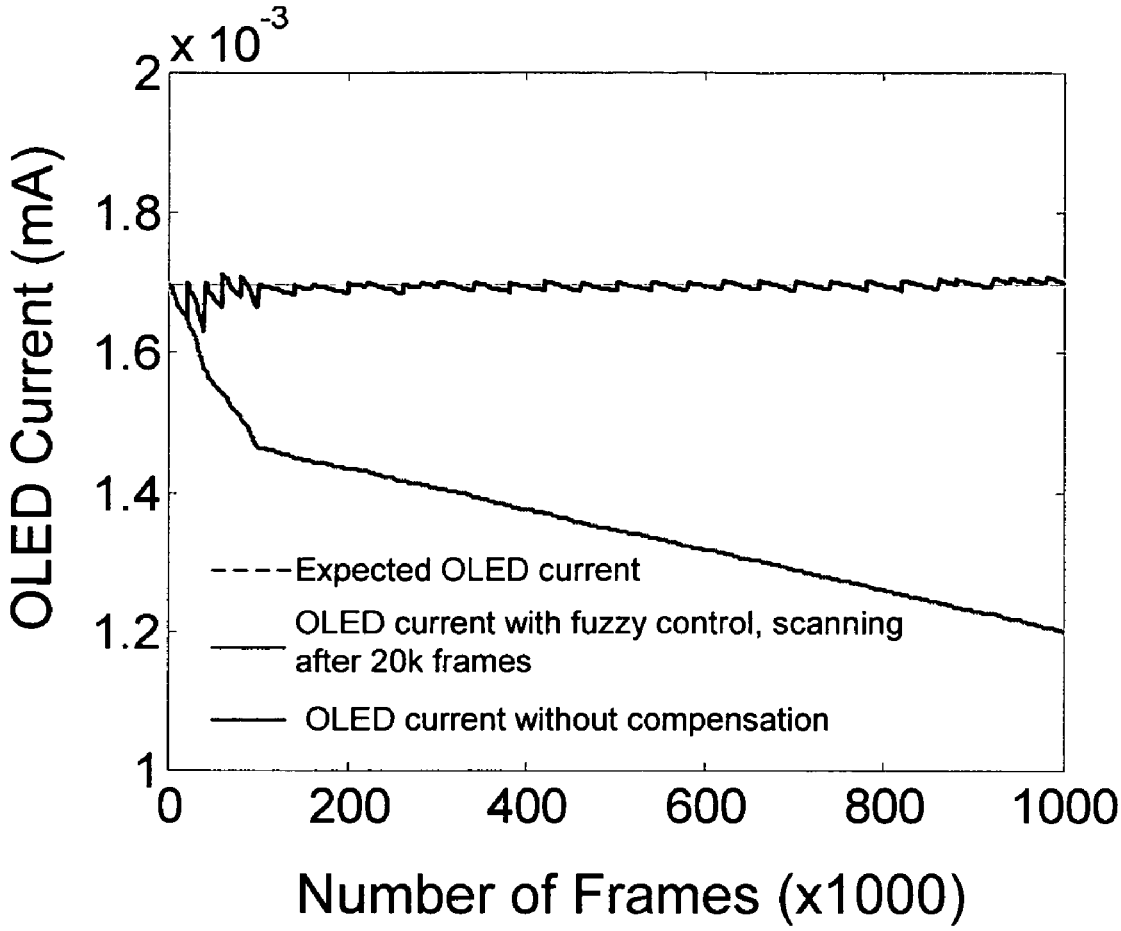
FIG. 4 is a graph showing a simulation result for the calibration technique.

A simulation for the calibration technique described above was implemented using a behavioral model of the devices. The behavioral model simulated a system using a mathematical equation that describes the system described above. The result of the simulation is illustrated in FIG. 4. The threshold voltage shift was based on a data input having a normal distribution. By implementing the calibration and compensation operation, the current mismatch decreases with time. This is due to the fact that with time, the calibration system (i.e. 100 of FIG. 1) has more information, thus can estimate the error more precisely.

When all of the pixels receive data voltages which belong to the same distribution, all pixels will have an almost identical threshold voltage shift. Thus, this can be compensated for by the use of one correction parameter w.

The calibration technique described above works more efficiently when all pixels receive data voltage chosen from the same probability distribution ([Ref. 4] W. Marco, "Low-power arithmetic for the processing of video signals," IEEE Trans. VLSI Systems, vol. 6, no. 3, pp. 493-497, September 1998.).

The calibration technique described above does not estimate the threshold voltage shift in each pixel circuit and provide individual correction. Instead, by providing all pixels with the same correction parameter w (e.g. the average of the correction parameters), the spatial and temporal resolution of the display is improved, and an efficient low cost solution is provided. Such an approach is efficient since the threshold voltage shift is rather small, and ball park values for the correction parameter are sufficient to remove observable gray level errors during the display operation.

The display array 20 of FIG. 1 may be an AMOLED display having a-Si based TFTs. The combination of the 2-TFT pixel circuit 2 of FIG. 2 and the calibration system 100 promises high spatial and temporal resolution, i.e. high speed, and higher yield.

However, the calibration technique in accordance with the embodiment of the invention is applicable to any display array other than the AMOLED display having a-Si based TFTs. The display array 20 may have a voltage-programmed pixel circuit other than a 2-TFT voltage programmed, AMOLED pixel circuit. The transistors may be fabricated using amorphous silicon, nano/micro crystalline silicon, poly silicon, organic semiconductors technologies (e.g., organic TFT), NMOS/PMOS technology or CMOS technology (e.g. MOSFET).

All citations are hereby incorporated by reference.

The present invention has been described with regard to one or more embodiments. However, it will be apparent to persons skilled in the art that a number of variations and modifications can be made without departing from the scope of the invention as defined in the claims.

What is claimed is:

1. A system for calibration of a display array having a plurality of pixel circuits in columns and rows, comprising:

a dummy pixel area having a plurality of dummy pixels in a dummy row, each corresponding to a pixel in a row of the display array;

an error extraction system for extracting an error between a current in a row of the display array and a reference current associated with the dummy row, the dummy pixels in the dummy row receiving a data voltage substantially identical to that received at the pixels in the corresponding row of the display array, the error extraction system including:

a first sensor for monitoring a current in the corresponding row of the display array; and a second sensor for monitoring a current in the dummy row and generating a reference current based on the monitored current in the dummy row; and an estimation system for estimating a correction parameter for compensating a data voltage provided to the display array, based on an error between the monitored current output from the first sensor and the reference current.

2. A system according to claim 1, comprising a system for controlling and scheduling a normal display operation and a calibration operation to the display array, and wherein the controlling and scheduling system selects a row of the display array so as to separately implement the calibration to the rows of the display array.

3. A system according to claim 2, comprising:

a first switch system for connecting voltage lines coupled to the pixel circuits in the row of the display array to a main voltage supply, a second switch system for selectively connecting a voltage line of the display array to the estimation system, and a third switch system for connecting the dummy pixel circuits to a driver for providing the data voltages, and wherein the controlling and scheduling system manages the operations of the first, second and third switch systems.

4. A system according to claim 3, wherein during the calibration operation, the voltage lines of the display array are sequentially connected to the error extraction system through the second switch system, and wherein the dummy pixel circuits are connected to the data driver through the third switch system.

5. A system according to claim 1, wherein the error extraction system comprises:

a comparator for comparing the monitored current output from the first sensor with the reference current output from the second sensor, and wherein during the calibration operation, the current in each row of the display array is monitored, and compared with the reference current.

6. A system according to claim 3, wherein during the normal display operation, the voltage lines of the display array are connected to the main voltage supply through the first switch system, and wherein the dummy pixel circuits are disconnected from the data driver.

7. A system according to claim 1, wherein the estimation system includes a look up table for storing a plurality of correction parameters, and the estimation system retrieves a corresponding correction parameter for the row of the display array from the look up table based on the error.

8. A system according to claim 7, wherein the estimation system retrieves the corresponding correction parameter for the row of the display array from the look up table based on the error and a total data voltage applied to the pixel circuits in the row of the display array.

9. A system according to claim 1, wherein data voltages for the pixel circuits in the display array are compensated based on the average of the correction parameters for the rows of the display array.

10. A system according to claim 1, wherein the error extraction system comprises:

a comparator for comparing the current monitored by the first sensor with the reference current to provide the error, and wherein the error estimation system comprises:

a circuit for calculating a mapping parameter associated with the correction parameter and specific to a total data voltage applied to the pixel circuits in the row of the display array and the transfer function of the comparator.

11. A system according to claim 1, wherein the estimation system comprises:

a calculation module for calculating a corresponding correction parameter for the row of the display array based on the error.

12. A system according to claim 11, wherein the calculation module calculates the corresponding correction parameter for the row of the display array based on the error and a total data voltage applied to the pixel circuits in the row of the display array.

13. A system according to claim 12, wherein data voltages for the pixel circuits in the display array are compensated based on the average of the correction parameters for the rows of the display array.

14. A system according to claim 1, wherein at least one of the first sensor and the second sensor includes a current mirror.

15. A system according to claim 1, wherein the pixel circuit includes a light emitting device and a driver transistor connected to the light emitting device, the light emitting device or the driver transistor being connected to a voltage supply in a corresponding row of the display array, and the first sensor monitoring a current drawn from the voltage supply.

16. A system according to claim 1, wherein the pixel circuit is a voltage programmed pixel circuit.

17. A system according to claim 1, wherein the display array is an AMOLED display array.

18. A system according to claim 1, wherein the display array has a-Si, polysilicon, or crystalline based backplane.

19. A system according to claim 1, wherein the pixel circuit has n-type transistors.

20. A system according to claim 1, wherein the pixel circuit has p-type transistors.

21. A method of calibration of a display array having a plurality of pixel circuits in columns and rows, comprising:

extracting an error, including:

in a calibration operation, providing a data voltage to a plurality of dummy pixel circuits in a dummy row, monitoring a current in the dummy row and generating a reference current based on the monitored current, a dummy pixel circuit corresponding to a pixel circuit in a row of the display array, in the calibration operation, providing the substantially identical data voltage to corresponding pixel circuits in the row of the display array and monitoring a current in the row of the display array, and obtaining the error between the monitored current in the row of the display array and the reference current; and estimating a correction parameter for compensating a data voltage provided to the display array in a normal display operation, based on the error.

22. A method according to claim 21, comprising:

selecting a next row of the display array and repeating the steps of extracting an error and estimating a correction parameter, and calculating an average of the correction parameters for the rows of the display array.

23. A method according to claim 22, comprising:

compensating data voltages for the pixel circuits in the display array based on the average of the correction parameters.

24. A method according to claim 21, wherein the step of providing data voltages to a plurality of dummy pixel circuits comprises:

connecting the dummy pixel circuits to a data driver for providing the data voltages.

25. A method according to claim 21, wherein the step of estimating comprises:

estimating the correction parameter for the row of the display array, based on the error and a total data voltage applied to the pixel circuits in the row of the display array.

26. A method according to claim 25, comprising compensating data voltages for the pixel circuits in the display array based on an average of the correction parameters for the rows of the display array.

27. A method according to claim 21, wherein the step of estimating comprises:

calculating a corresponding correction parameter for the row of the display array, based on the error.

28. A method according to claim 21, wherein the step of estimating comprises:

retrieving a corresponding correction parameter for the row of the display array from a look up table based on the error.

29. A method according to claim 21, wherein the step of monitoring a current in the row of the display array comprises:

monitoring the current in the row of the display array through a voltage line coupled to the pixels circuits in the row of the display array.

30. The method of claim 21, further comprising:

controlling and scheduling the normal display operation and the calibration operation by:

connecting voltage lines coupled to the pixel circuits in the row of the display array to a main voltage supply during the normal display operation;

selectively connecting a selected voltage line of the voltage lines of the display array during the calibration operation to extract the error; and connecting the dummy pixel circuits to a driver for providing the data voltages during the calibration operation.

31. A system for calibration of a display array having a plurality of pixel circuits in columns and rows, comprises:

a dummy pixel area having a plurality of dummy pixel circuits in a dummy row, each corresponding to a pixel circuit in a row of a display array, a device for controlling a calibration operation for the display array, pixel circuits in the row of the display array receiving a data voltage and the dummy pixel circuits receiving a data voltage substantially identical to that received at the pixel circuits in the row of the display array, a comparator for comparing a current in the row of the display array with a current in the dummy row and outputting an error based on the comparison result, and an estimation system for estimating a correction parameter for compensating a data voltage provided to the display array, based on the error.

32. A system according to claim 31, wherein the estimation system comprises:

a look up table for storing a plurality of correction parameters, the estimation system retrieving a corresponding correction parameter for the row of the display array from the look up table based on the error.

33. A system according to claim 32, wherein the estimation system retrieves the corresponding correction parameter for the row of the display array from the look up table based on the error and a total data voltage applied to the pixel circuits in the row of the display array.

34. A system according to claim 33, data voltages for the pixel circuits in the display array are compensated based on the average of the correction parameters for the rows of the display array.

35. A system according to claim 33, wherein the look up table includes a mapping parameter specific to the total data voltage and the transfer function of the comparator.

36. A system according to claim 31, wherein the estimation system comprises:

a calculation module for calculating a corresponding correction parameter for the row of the display array based on the error.

37. A system according to claim 36, wherein the calculation module calculates the corresponding correction parameter for the row of the display array based on the error and a total data voltage applied to the pixel circuits in the row of the display array.

38. A system according to claim 37, wherein data voltages for the pixel circuits in the display array are compensated based on the average of the correction parameters for the rows of the display array.

39. A system according to claim 31, comprising:

a first module for monitoring the current in the row of the display array in the calibration operation; and a second module for monitoring the current in the dummy row in the calibration operation, at least one of the first module and the second module including a current mirror.

40. A system according to claim 31, wherein the pixel circuit includes a light emitting device and a driver transistor connected to the light emitting device, the light emitting device or the driver transistor being connected to a voltage supply in a corresponding row of the display array, and wherein the current in the row of the display array is monitored from the voltage supply.

41. The system of claim 31, further comprising:

a controller and scheduler system for controlling and scheduling a normal display operation and a calibration operation to the display array, and wherein the controller and scheduler system selects a row of the display array so as to separately implement the calibration to the rows of the display array;

a first switch system for connecting voltage lines coupled to the pixel circuits in the row of the display array to a main voltage supply;

a second switch system for selectively connecting a voltage line of the display array to the estimation system; and a third switch system for connecting the dummy pixel circuits to a driver for providing the data voltages, wherein the controller and scheduler system manages the operations of the first, second and third switch systems.

42. A system for calibration of a display array having a plurality of pixel circuits in columns and rows, comprising:

a dummy pixel area having a plurality of dummy pixels in a dummy row, each corresponding to a pixel in a row of the display array;

an error extraction system for extracting an error between a current in a row of the display array and a reference current associated with the dummy row, the dummy pixels in the dummy row receiving a data voltage substantially identical to that received at the pixels in the corresponding row of the display array, the error extraction system including:

a first sensor for monitoring a current in the corresponding row of the display array; and a second sensor for monitoring a current in the dummy row and generating a reference current based on the monitored current in the dummy row;

an estimation system for estimating a correction parameter for compensating a data voltage provided to the display array, based on an error between the monitored current output from the first sensor and the reference current;

a controller and scheduler system for controlling and scheduling a normal display operation and a calibration operation to the display array, and wherein the controller and scheduler system selects a row of the display array so as to separately implement the calibration to the rows of the display array;

a first switch system for connecting voltage lines coupled to the pixel circuits in the row of the display array to a main voltage supply;

a second switch system for selectively connecting a voltage line of the display array to the estimation system; and a third switch system for connecting the dummy pixel circuits to a driver for providing the data voltages, wherein the controller and scheduler system manages the operations of the first, second and third switch systems.

* * * * *